US006057500A

United States Patent [19]

Liao

[11] Patent Number: 6,057,500

[45] Date of Patent: May 2, 2000

[54] ANGLE ADJUSTABLE CYMBAL CLAMP

[75] Inventor: Tsun-Chi Liao, Taichung, Taiwan

[73] Assignee: HWA Shin Musical Instrument, Co., Ltd., Taichung, Taiwan

[21] Appl. No.: 09/352,757

[22] Filed: Jul. 14, 1999

[51] Int. Cl.[7] ..... G10D 13/02

[52] U.S. Cl. ..... 84/422.3; 84/421; 84/422.2; 403/86

[58] Field of Search ..... 84/422.1, 422.2, 84/422.3, 421; 403/86

[56] References Cited

U.S. PATENT DOCUMENTS 5,063,819 11/1991 Hoshino ..... 84/422.3

*Primary Examiner*—Robert E. Nappi
*Assistant Examiner*—Shih-yung Hsieh
*Attorney, Agent, or Firm*—Bacon & Thomas, PLLC

[57] ABSTRACT

An improved angle adjustable cymbal clamp mainly comprises an upper clamp sitting on a lower base and a clasping piece with a washer disposed on the upper clamp, wherein the lower base is provided with an oblique contact face formed on its top face and a cymbal rod protruded upwards at its center; a through hole is made in the upper clamp for the cymbal rod of the lower base to penetrate, and an accommodating space is preserved at a lower portion in the upper clamp. Another oblique contact face and a plurality of vertical grooves are disposed in inner wall and in ceiling of the accommodating space respectively, and a projecting piece with a vertical slit is arranged laterally to the upper clamp, wherein a bolt is penetrably locked in the projecting piece. In virtue of abovesaid construction of this invention, change of the angle between the upper clamp and the lower base by turning those two oblique contact faces is possible. Besides, as the screwing direction of the bolt isn't located in the same plane with those two contact faces, and with the favorable frictional grooves and rim of the lower base, the upper clamp is capable of keeping itself in an adjusted angle without turning subsequent to screwing the bolt for locking.

2 Claims, 5 Drawing Sheets

ANGLE ADJUSTABLE CYMBAL CLAMP

BACKGROUND OF THE INVENTION

This invention relates to a musical instrument, particularly to an angle adjustable cymbal clamp that is utilized to change a lower cymbal for presenting special sound effects when tapping.

A fixing clamp is usually employed to fix a lower cymbal on a conventional cymbal stand, so that an upper cymbal is dragged to strike the lower cymbal to create sound when a drummer is pedaling. Later on, some people have tried to change angle of the lower cymbal for creating special sound effects and designed an angle adjustable cymbal clamp as shown FIGS. 1 and 2, wherein an adjusting bolt is employed to lock on the fixing clamp obliquely in different depths as a measure for adjusting angle of the lower cymbal. However, some defects are found after using a period of time:

1. A single-point pressing and supporting method by using the adjusting bolt to change oblique angle of the lower cymbal is liable to have the lower cymbal swayed to create noise.
2. After using a period of time, the adjusting bolt may get loosened gradually by shock to deflect and lose the preferred angle, so that it requires adjustment from time to time.

In view of the above-described imperfections, after years of constant effort in research, the inventor of this invention has consequently developed and proposed this improved mechanism pertaining to the subject matter.

SUMMARY OF THE INVENTION

This invention is proposed to form an oblique contact face in an upper clamp and a lower base respectively, so that change of oblique angle of those two contact faces can adjust cymbal angle easily, which will be kept unchanged when tapping.

The related skill of this invention is embodied below:

This invention relates to an angle adjustable cymbal clamp, comprising a lower base, an upper clamp, and a clasping piece. The upper clamp is located overlapping the lower base, and a clasping piece and a wash are penetrably disposed on the upper clamp. The lower base is provided with an oblique contact face on its top and a protruded cymbal rod in its center. The upper clamp is provided with a through hole in center for the cymbal rod to penetrate, an accommodating space having an oblique contact face and a plurality of vertical grooves, and a lateral projecting piece with a vertical slit which is to be opened or closed by a bolt. By the abovesaid construction and turning those two oblique contact faces, the angle change between the upper clamp and the lower base may be conducted. And, as the screwing direction of the bolt is not located in the same plane with those two oblique contact faces, and in virtue of a frictional force created from the vertical grooves as well as the rim of the lower base, the upper clamp will not turn after turning of the bolt when screwing to lock on the projecting piece of the upper clamp for keeping at an adjusted oblique angle.

BRIEF DESCRIPTION OF THE DRAWINGS

For a better understanding to the present invention, together with further advantages or features thereof, at least one preferred embodiment will be elucidated below with reference to the annexed drawings in which.

DETAILED DESCRIPTION OF THE PREFERRED EMBODIMENT

Figure 1:
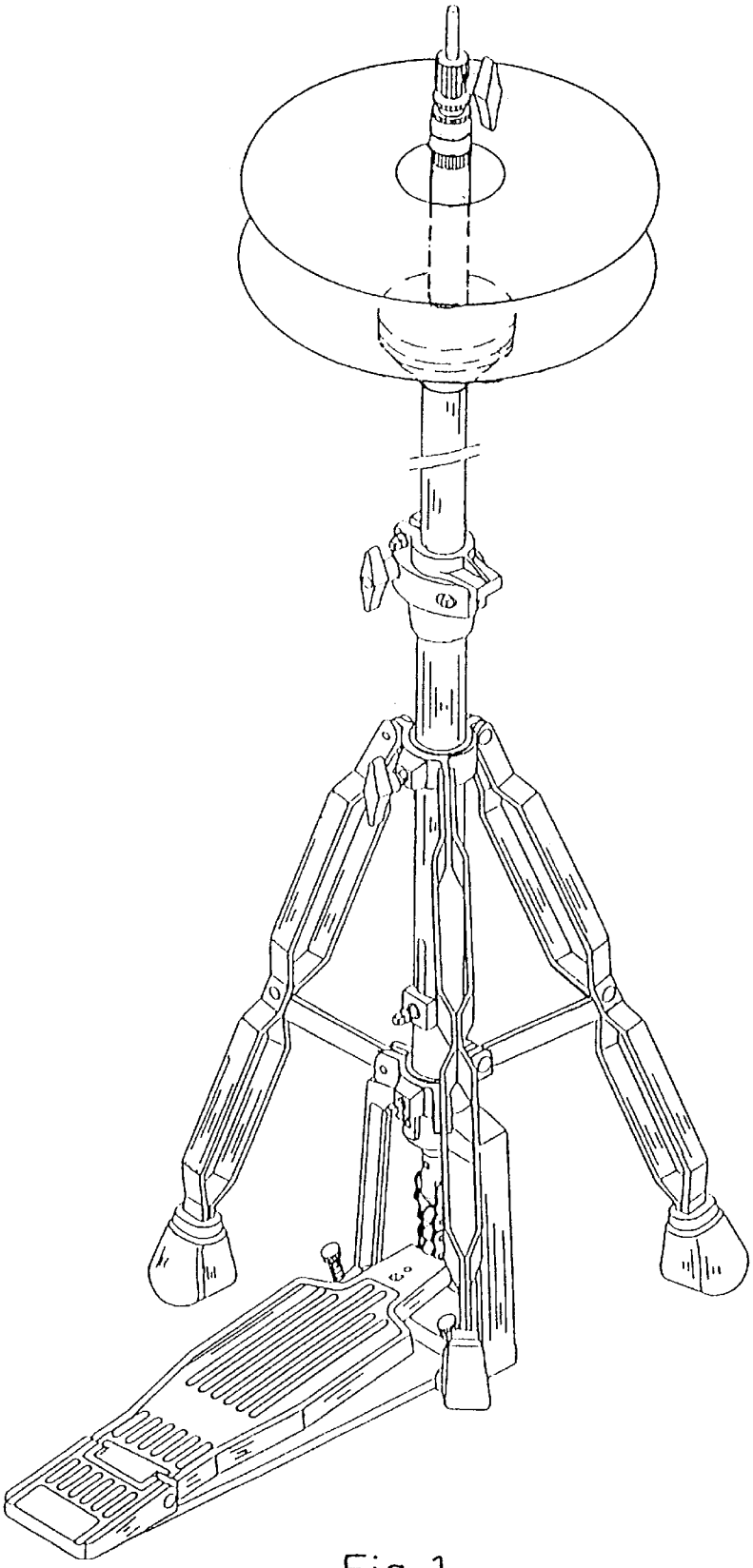
Fig 1 PRIOR ART
FIG. 1 is an elevational view of a conventional cymbal stand according to the prior art.
Figure 2:
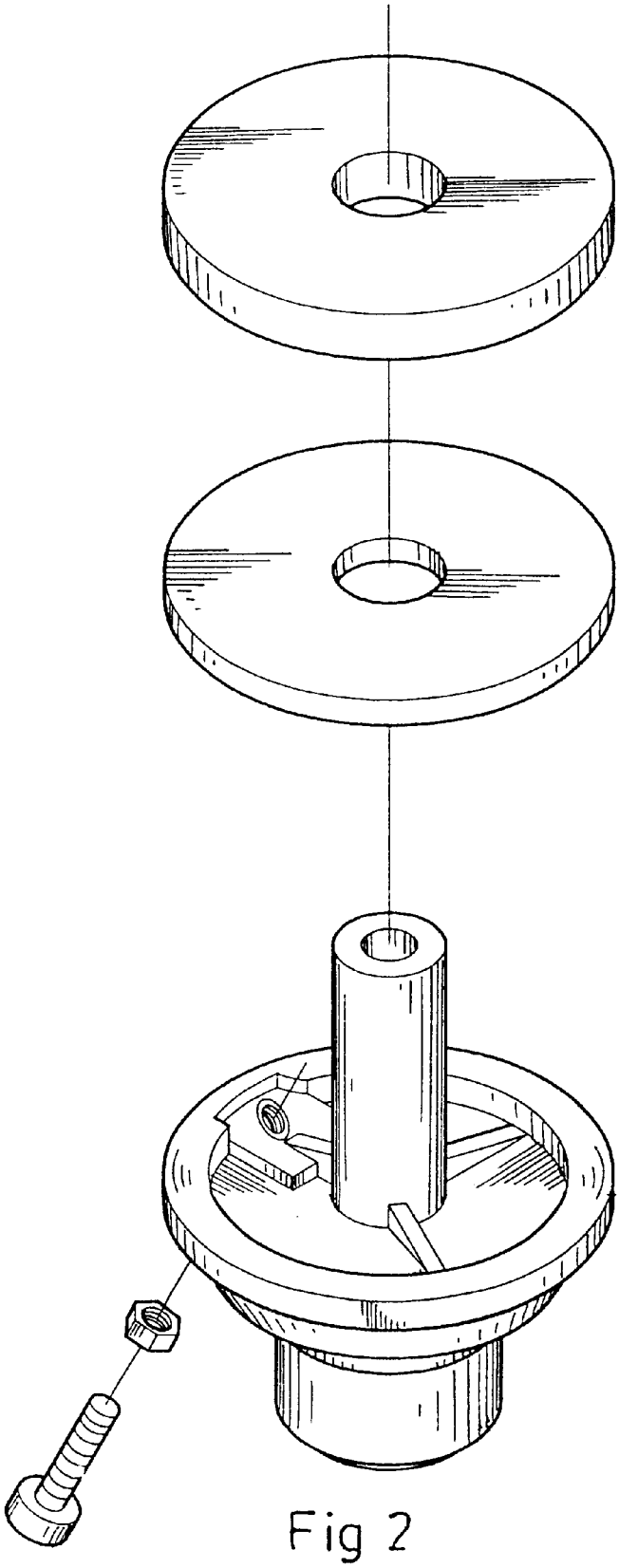
Fig 2 PRIOR ART
FIG. 2 is a three-dimension exploded view of a conventional clamp according to the prior art.

As shown in FIG. 3 through FIG. 5B, an angle adjustable cymbal clamp of this invention mainly comprises a lower base 10, an upper clamp 20, and a clasping piece 30, all attached to a stand 2.

The lower base 10 in shape of a cylinder is provided with an oblique upper contact face 11, wherein a cymbal rod 12 protruded upwards is disposed in center of the contact face 11; a ladder-like through hole 13 hollows the cymbal rod 12 to become a tube for a center rod 5 to plug inside and penetrate the entire lower base 10 via the through hole 13; a circular hole 15 coincident with the through hole 13 at center is formed in a support rod 14 beneath the lower base 10 to enable the center rod 5 to penetrate and combine with the stand 2.

The upper clamp 20 having a through hole 21 in center is collared onto the cymbal rod 12 of the lower base 10 that penetrates the upper clamp 20. In a lower portion of the upper clamp 20, an accommodating space 22 with a downward opening is preserved, wherein an oblique contact face 23 corresponding to the contact face 11 of the lower base 10 is formed at an inner ceiling of the accommodating space 22; in addition, the upper clamp 20 is provided with a lateral projecting piece 24, which is split to form a slit 25 to communicate with the through hole 21; and a plurality of vertical grooves 26 in equal interval is arranged on inner wall opposite to the projecting piece 24. A traverse tapped hole 27 is disposed in the projecting piece 24 for a bolt 28 to penetrate and get locked. When the bolt 28 is locked tightly, the slit 25 of the projecting piece 24 will get closed to press the through hole 21 hard to in turn clamp the cymbal rod 12 of the lower base 10 tightly.

The clasping piece 30 is a felt-made disk sitting above the upper clamp 20 on a washer 31.

Figure 3:
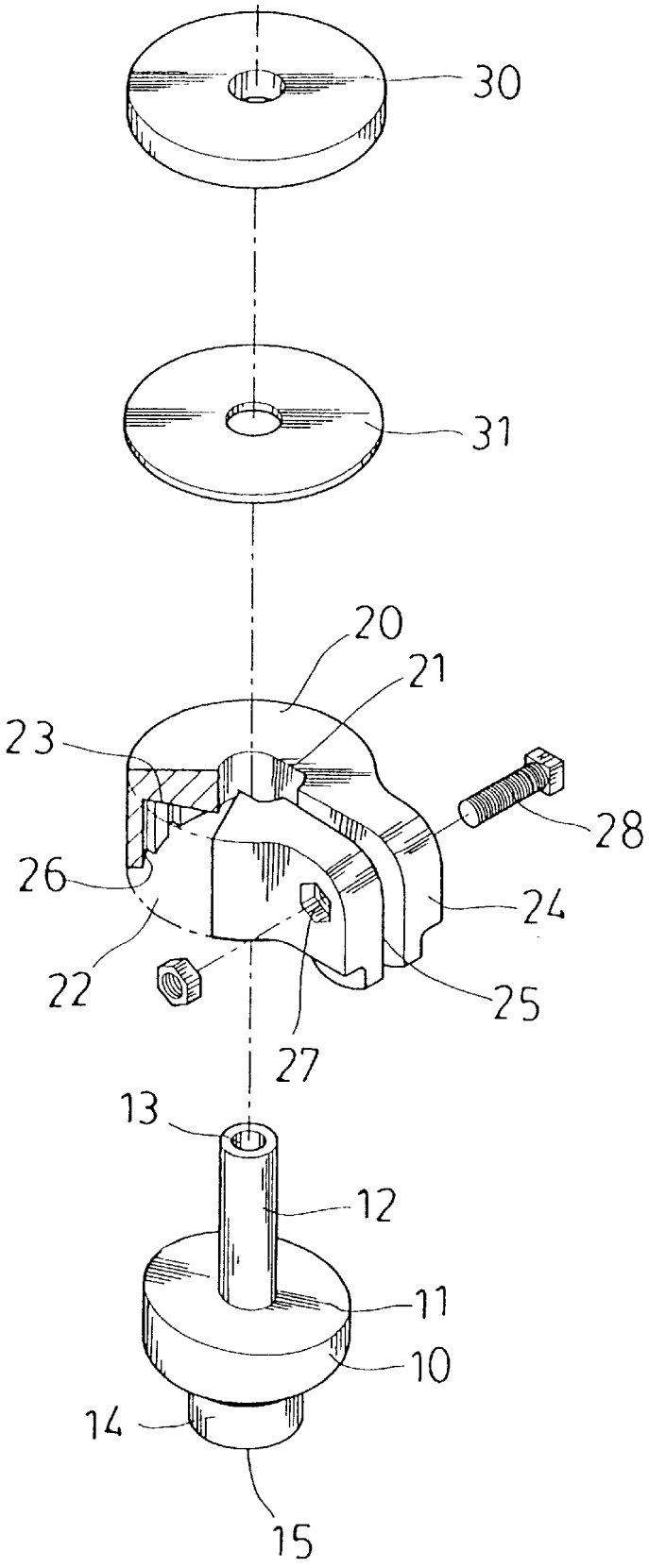
FIG. 3 is a three-dimension exploded view showing a preferred embodiment of this invention.
Figure 4:
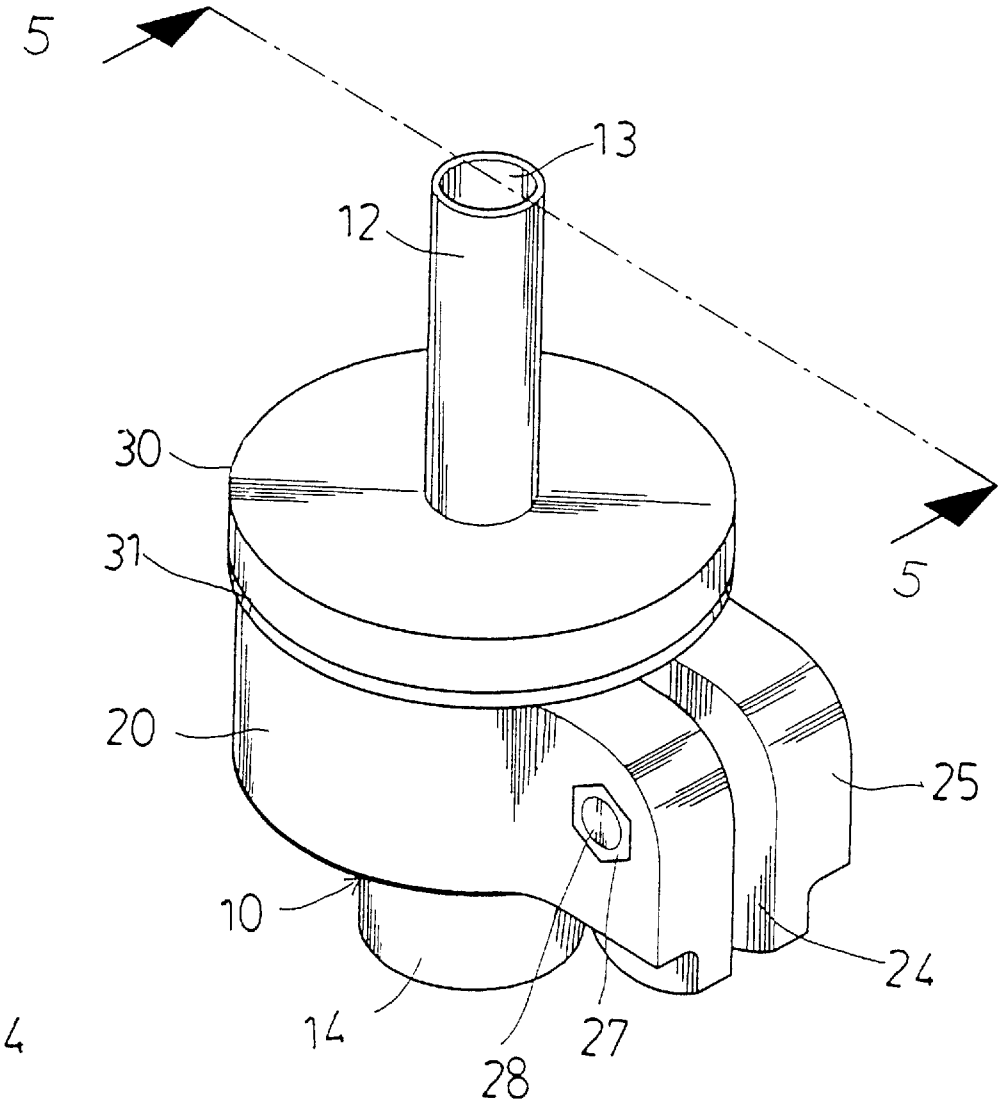
FIG. 4 is a three-dimension assembled view of the FIG. 3.

FIG. 4 is an assembled body of the components in FIG. 3, wherein a lower cymbal is pressed and fixed by the clasping piece 30; the upper clamp 20 is hitched onto the cymbal rod 12 of the lower base 10, where the cymbal rod 12 penetrates the through hole 21 in the upper clamp 20; the bolt 28 is locked in the tapped hole 27 in the projecting piece 24, and when the bolt 28 is locked tightly, the slit 25 of the projecting piece 24 will be closed to shrink the through hole 21 and thereby to clench the cymbal rod 12 tightly; and the plurality of favorable vertical grooves 26 create a frictional resistance with circumferential edge of the lower base 10 will prevent a relative rotation of the upper clamp 20 to the lower base 10 when the bolt 28 is screwing to lock on the upper clamp 20.

Figure 5B:
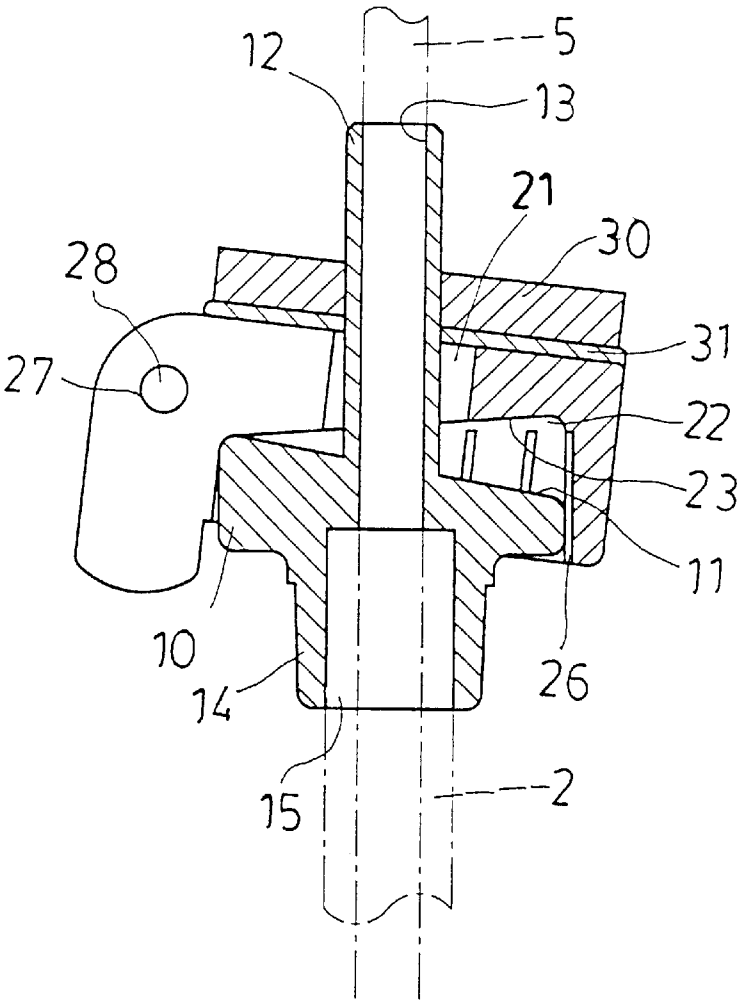
FIG. 5B is a schematic view showing action of the FIG. 5A.
Figure 5A:
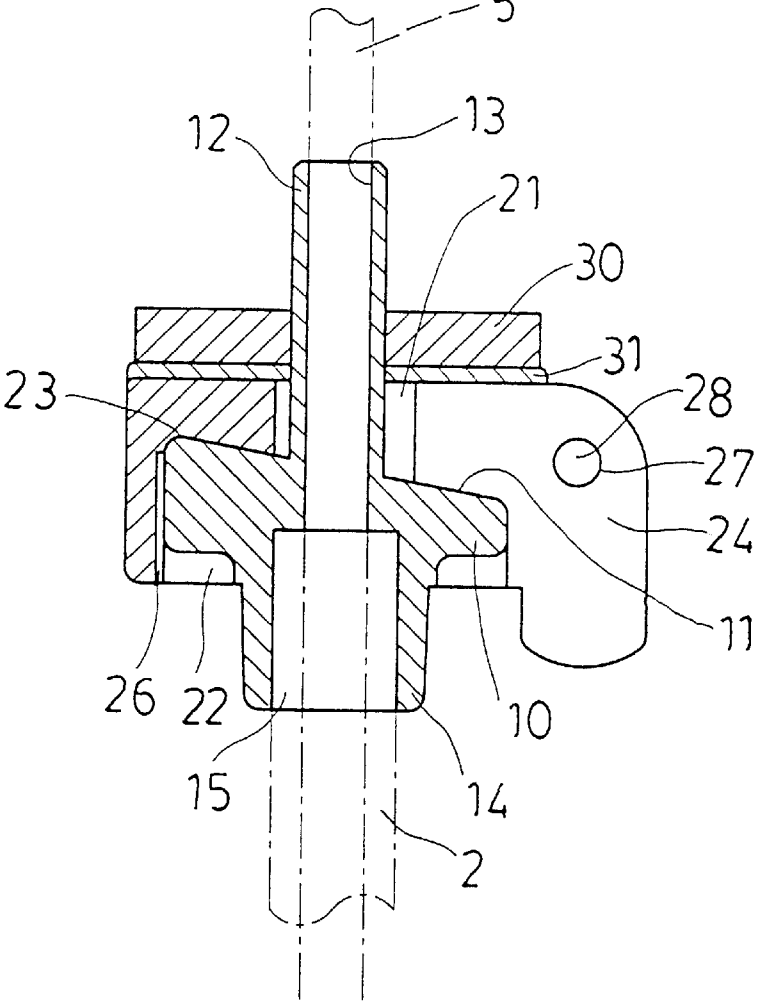
FIG. 5A is a cutaway sectional view along line 5—5 in the FIG. 4.

Under normal condition, the contact face 11, 23 of the lower base 10 and the upper clamp 20 are inclined in same oblique angle, so that a lower cymbal is standing horizontally as shown in FIG. 5A. When an oblique angle of the lower cymbal is desired for a special sound effect, a drummer is supposed to turn the locked bolt 28 backwards to loosen the through hole 21, then turn the upper clamp 20 to change the contact relationship between those two contact faces 11, 23 as shown in FIG. 5B. At this time, a relatively lower portion of the contact face 23 contacts with a relatively higher portion of the contact face 11, and is choked in the accommodating space 22, thereby the upper clamp 20 becomes obliquely and so does the lower cymbal. The user is now to lock the bolt 28 again to close the slit 25 in a reverse way that shrinks accordingly the through hole 21 to have the upper clamp 20 clasped the cymbal rod 12 tightly. And at this moment, as the screwing direction of the bolt 28 isn't located in the same plane with those two contact faces 11, 23, the upper clamp 20 will not turn after the bolt 28 to change its oblique angle.

From the above described, the merits of this invention may be summarized as the following:

1. This invention avails itself of turning of two oblique contact faces to create angle change of the upper clamp 20 and the lower base 10 that can avoid sway of the lower cymbal in order not to produce any noise when tapping, in comparison with a conventional stand, wherein an adjusting threaded bolt is utilized to screw in different depths to change the oblique angle of a lower cymbal.
2. As the screwing direction of the bolt 28 isn't located in the same plane with those two contact faces 11, 23, therefore, the upper clamp 20 will not turn after the bolt 28 every time when the latter is utilized to lock on the former. So that, the upper clamp 20 can keep its oblique angle until another change is desired.
3. The vertical grooves 26 in the accommodating space 22 will create a frictional resistance with circumferential edge of the lower base 10 to prevent a relative rotation of the upper clamp 20 to the lower base 10 when the bolt 28 is screwing to lock on the upper clamp 20.

Although, this invention has been described in terms of preferred embodiments, it is apparent that numerous variations and modifications may be made without departing from the true spirit and scope thereof, as set forth in the following claims.

What is claimed is:

1. An improved angle adjustable cymbal clamp, comprising:

an upper clamp;

a lower base carrying said upper clamp; and a clasping piece and a washer hitched onto said upper clamp; and wherein:

an oblique contact face is formed on said lower base, and a top end tapped cymbal rod protruded upwards is located in center of said lower base; said upper clamp having a through hole in its center for said cymbal rod of the lower base to penetrate is sitting on said lower base; an accommodating space with a downward opening is offered in a lower portion of said upper clamp, and an oblique contact face is formed on ceiling of said accommodating space corresponding to said oblique contact face of said lower base; and a projecting piece having a vertical slit is provided laterally to said upper clamp, also, a traverse tapped hole is formed in said projecting piece for a bolt to get locked penetrably; and by the abovesaid construction of this invention, turning those two said oblique contact faces to change the angle between said upper clamp and said lower base being possible; and as the screwing direction of said bolt located not in the same plane with those two said oblique contact faces, said upper clamp being capable of keeping itself in a fixed angle without turning subsequent to screwing said bolt.

2. The improved angle adjustable cymbal clamp according to claim 1, wherein a plurality of equal-interval vertical groove disposed in the inner wall of said accommodating space at one side opposite to said projecting piece combines with rim of said lower base to enhance frictional force for keeping an adjusted oblique angle.

* * * * *